United States Patent [19]

Williams et al.

[11] Patent Number: 4,638,952

[45] Date of Patent: Jan. 27, 1987

[54] METHOD OF FLUID COKE REDUCTION

[75] Inventors: Robert M. Williams, Ladue; Robert M. Williams, Jr., Webster Groves, both of Mo.

[73] Assignee: Williams Patent Crusher and Pulverizer Company, St. Louis, Mo.

[21] Appl. No.: 763,516

[22] Filed: Aug. 8, 1985

[51] Int. Cl.[4] ..... B02C 19/12

[52] U.S. Cl. ..... 241/3; 44/1 C; 241/29; 241/97; 241/101.4

[58] Field of Search ..... 241/3, 101.4, 29, 80, 241/97, 23, 24, 17, 48, 52, 53, 152 A; 44/1 C

[56] References Cited

U.S. PATENT DOCUMENTS

| | | | |
|---|---|---|---|
| 3,951,347 | 4/1976 | Tiggesbaumker et al. | 241/80 X |
| 4,175,708 | 11/1979 | Kawabe et al. | 241/29 X |
| 4,245,570 | 1/1981 | Williams | 241/52 X |

*Primary Examiner*—Mark Rosenbaum

*Attorney, Agent, or Firm*—Gravely, Lieder & Woodruff

[57] ABSTRACT

Apparatus for and method of reducing spherically shaped fluid coke waste by-product pellets into a pulverized condition for use as a fuel in which there is a first grinding and pulverizing mill initially receiving the waste material which, because of its spherical shape is difficult to pulverize, and accordingly the waste material is transported to a second grinding mill where its spherical shape is altered to render it more easily pulverizable upon return to the first grinding mill where the final pulverizing of the waste material takes place prior to discharge to a point of use which may be to directly fire a furnace, a boiler or a kiln. The waste material is usually rather wet and requires drying so as not to choke the grinding apparatus, and for this purpose heat generated during the burning of the pulverized waste material is returned to the apparatus for the purpose of drying the waste material during its processing in the respective mills.

4 Claims, 2 Drawing Figures

METHOD OF FLUID COKE REDUCTION

BACKGROUND OF THE INVENTION

1. Field of the Invention

This invention is concerned with apparatus and method for the reduction of the spherical pellets making up fluid coke produced as a waste material in the refining of petroleum so as to render the same suitable as a heat source by burning.

2. Description of the Prior Art

The source of fluid coke is a by-product of petroleum refining, and results in producing a waste component in the form of pellets that are spherical and therefore difficult to grind so as to condition the waste for burning.

The problem encountered in attempting to grind fluid coke particles is that such particles have a spherical shape which renders them exceedingly strong and resistant to grinding in a roller mill. The spherical shape must be altered if successful grinding and pulverizing is to be accomplished economically.

BRIEF DESCRIPTION OF THE INVENTION

The present invention is directed to a method whereby the spherical pellets of a fluid coke petroleum derivative can be effectively altered sufficiently to render the pellets grindable in a roller mill to a size for use as a fuel.

An equally important object of the present invention is to provide an arrangement of apparatus which prepares the pelletized waste material for its eventual reduction by being pulverized to a significant degree of fineness which is within the capability of a roller mill.

It is an object of the present invention to feed the fluid coke pellet waste material through a reduction system which includes a roller mill for initial drying, then discharges the material to a hammer mill where the high speed action of the hammers alters the shape to other than spherical, and then the material in its altered shape is returned to the roller mill for final pulverization to a size which may be like smoke due to its fineness. The result of the foregoing treatment renders the fluid coke waste material suitable for use as a fuel in firing a boiler, and a portion of the boiler heat production is employed to heat air directed through the mill air drying the material during the movement in the system.

BRIEF DESCRIPTION OF THE DRAWING

The present invention has been disclosed in FIG. 1 in a schematic rendering of appropriate apparatus that will illustrate the method that has been found suitable for reducing fluid coke waste material to a condition suitable as a fuel in direct fired systems. An alternate schematic rendering of apparatus is disclosed in FIG. 2.

DESCRIPTION OF A PREFERRED EMBODIMENT

Figure 1:
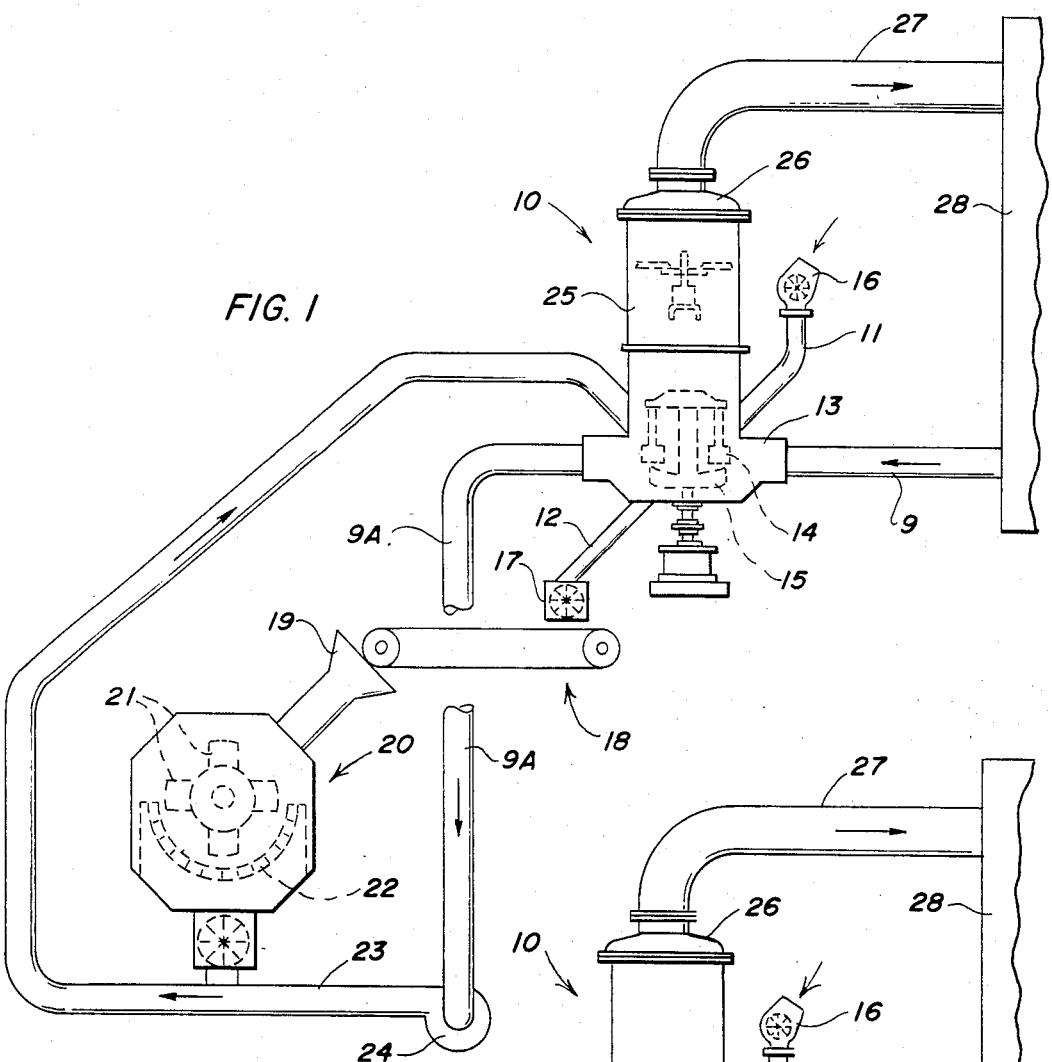

In the FIG. 1 view, a pulverizer type roller mill 10 of the character shown in U.S. Pat. No. 4,245,570 and incorporated herein by reference, has been depicted in sufficient detail to show the travel of the air and fluid coke waste material through it from the feed conduit 11 to its discharge outlet conduit 12, and the supply in conduit 9 of hot air or gas to a bustle 13 surrounding the chamber in which the grinding and pulverizing rolls 14 operate along with plows 15. The conduit 11 is equipped with a rotary pocket feeder 16 which can be controlled to regulate the rate of feed to the mill grinding chamber. The outlet conduit 12 is provided with a rotary gate 17 to allow the fluid coke pellet waste material to exit from the mill chamber and land on a suitable conveyor 18.

The conveyor 18 delivers the fluid coke pellet waste material to the inlet 19 of a hammer mill 20 in which a rotor equipped with hammer elements 21 operates in a chamber having an outlet grate 22 formed with openings of a predetermined size that discharges the waste material after its shape has been altered by the impact effect of the high tip speed of the hammers 21. The material discharged from the grate 22 passes into a collecting conduit 23 which directs a gas stream from the blower 24 through the conduit to deliver the material back to the mill 10 where it can be reduced to a desired size and discharged through a size classifier 25 in advance of the mill outlet 26 for delivery by conduit 27 to a boiler 28 where it is burned.

The movement of hot gas or air from the boiler 28 is effected by the blower 24 connected into the bustle 13 of mill 10 to establish a negative flow system in which the blower 24 draws hot gas into the mill 10 through the conduit 9 and by conduit 9A to the blower 24. While the primary drying occurs in mill 10, there is some drying that takes place in the mill 20. The output from the mill 20 is conveyed through conduit 23 back to the mill 10 where it is fine ground or pulverized to a U.S. sieve size of 90–325 mesh.

The initial condition of the fluid coke waste material usually contains 8 to 15 percent moisture which needs to be removed. The removal of the moisture is initiated in the mill 10 by the hot gas or air which enters at the bustle 13. The pellets released at the outlet conduit 12 are relatively dry before they enter the hammer mill 20 so it will not choke or blind the grate openings. To accommodate the size and shape alteration of the pellets being carried out in the hammer mill 20, the grate is provided with suitably sized outlet openings which desirably are of about 3/32 inch. The product passed by the grate 22 is conveyed by the hot gas through the conduit 23 back to the roller mill 10 whereby the now altered shape readily lends itself to grinding by the rollers 14 in that mill 10. Any particles that are not ground sufficiently are recycled automatically.

Figure 2:
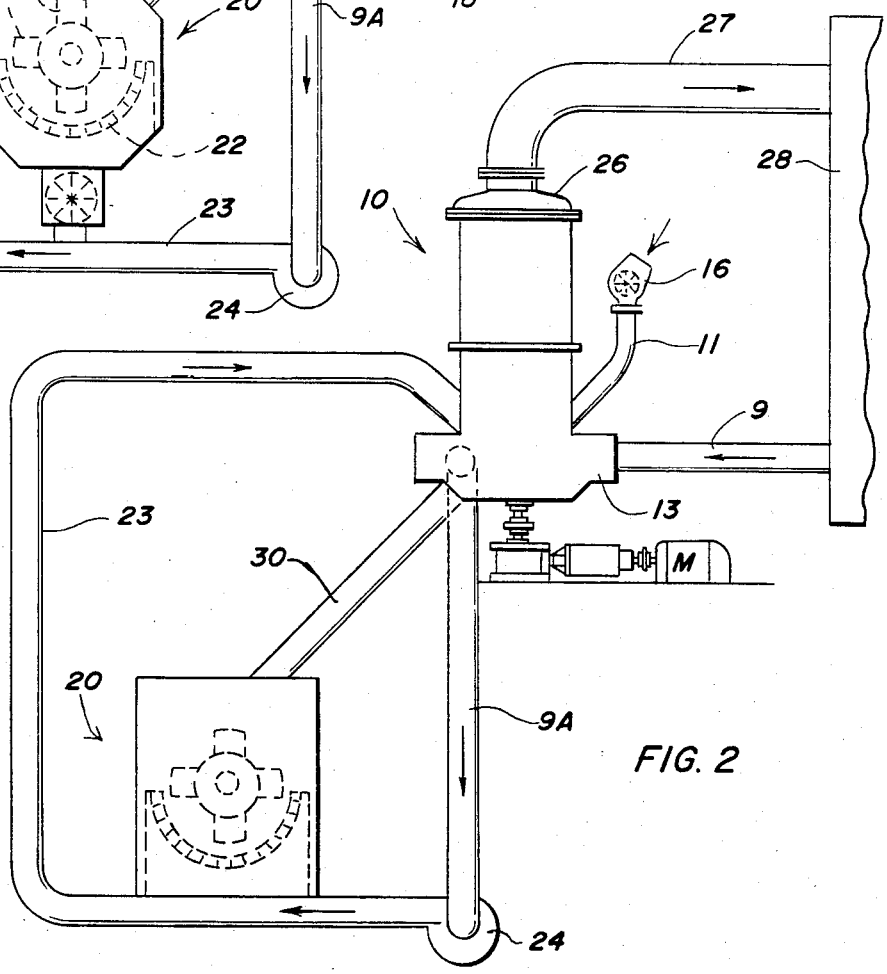

The alternate system disclosed in FIG. 2 embodies a closed circuit system in which certain components that are similar to those identified in FIG. 1 will have the same reference characters. Thus, the material to be ground and pulverized is received at the inlet 16 and directed into the grinding chamber of the roller mill 10. Since it is known that the pellets constituting the major portion of the fluid coke waste material are spherically shaped, it is necessary to alter that shape so as to be able to pulverize the same. Therefore, the pellets are discharged through conduit 30 from the bottom of the mill 10 directly into the hammer mill 20. As before noted, the high speed hammers alter the shape of the pellets and pass to the hammer mill outlet through the openings in the grate 22. The mill outlet is connected to conduit 23 where the material is blown by the air from blower 24 back to the roller mill 10 where it can be pulverized to a fineness of the order of 90–325 mesh. The closed system of FIG. 2 has eliminated the rotary valves and transfer conveyor disclosed in the system of FIG. 1.

The foregoing description has set forth systems of conducting or moving the waste material between the first and second grinding mills 10 and 20 so that the pelletized form of the waste material initially received by the mill 10, but not effectively ground in its initial spherical shape, is passed out and moved into the second mill 20 which provides a high tip speed hammer rotor for effectively altering the shape of the individual pellets so that on being returned to the first mill the rollers are able to finish the grinding and pulverizing thereof. A grate in the second mill 20 allows the desirably sized material to pass into the system and travel to the first mill 10 for final reduction. The fuel material from the outlet 26 is moved into a suitable boiler, kiln, or similar item of equipment 28 where a supply of hot gas can be made available for drying of the material in the foregoing system.

While presently preferred items of apparatus have been disclosed to make up the systems, it is understood that equivalent apparatus may be employed to practice the present invention.

What is claimed is:

1. A method of reducing spherically shaped pelletized fluid coke waste by-product produced in the refining of petroleum, which method comprises:

(a) feeding the pelletized fluid coke waste into a first stage pulverizing and grinding mill for an initial reduction of such waste, including so much of the pellets as can be reduced;

(b) transporting the unreduced pellets of the fluid coke waste out of the first stage pulverizing and grinding mill into a separate second stage mill for reshaping of the spherical shaped pellets by hammer impact; and (c) collecting the pellets after being reshaped and returning the collected reshaped pellets to the first stage mill for final pulverization reduction.

2. A method according to claim 1 in which a step of drying the fluid coke waste takes place in the first stage mill and in collecting and returning the reshaped waste to the first stage from the second stage mill.

3. A method according to claim 1 in which the final pulverization reduction of the waste is burned and a portion of the heat of that burning is introduced into the first stage mill for drying purposes.

4. A method of processing petroleum refinery pelletized fluid coke waste material to reduce the pelletized waste for use as a fuel, the method comprising:

(a) the step of passing the pelletized waste material through a pulverizing mill and to an impact mill for altering the shape of the pellets to make them susceptible to pulverization;

(b) the step of returning the reshaped pellets from the impact mill to the pulverizing mill where final pulverization of the pelletized fluid coke waste material takes place;

(c) delivering the final pulverized waste material to a place of burning as a fuel; and (d) applying at least a portion of the heat of the burning of the pulverized waste material to the drying of the waste material during the processing thereof, at least in the first step.

* * * * *

UNITED STATES PATENT AND TRADEMARK OFFICE

CERTIFICATE OF CORRECTION

PATENT NO. : 4,638,952

DATED : January 27, 1987

INVENTOR(S) : Robert M. Williams and Robert M. Williams, Jr.

It is certified that error appears in the above-identified patent and that said Letters Patent are hereby corrected as shown below:

Column 1, line 45, "air" second occurrence, should be "for".

Signed and Sealed this

Twenty-first Day of April, 1987

*Attest:*

DONALD J. QUIGG

*Attesting Officer*

*Commissioner of Patents and Trademarks*